US005707753A

United States Patent [19]

Kurihara et al.

[11] Patent Number: 5,707,753

[45] Date of Patent: Jan. 13, 1998

[54] PULSE GENERATING ELEMENT AND A METHOD AND AN APPARATUS FOR MANUFACTURING THE SAME

[75] Inventors: Tatsuya Kurihara; Itsuo Takeuchi; Tsukasa Higashi, all of Yokohama; Hajime Arai, Kawasaki, all of Japan

[73] Assignee: NHK Spring Co., Ltd, Yokohama, Japan

[21] Appl. No.: 552,037

[22] Filed: Nov. 2, 1995

[30] Foreign Application Priority Data

Nov. 4, 1994 [JP] Japan ..... 6-271118

[51] Int. Cl.[6] ..... H01F 1/00

[52] U.S. Cl. ..... 428/611; 428/315; 428/379; 428/615; 428/617

[58] Field of Search ..... 428/611, 379, 428/375, 615, 617, 621

[56] References Cited

U.S. PATENT DOCUMENTS

| | | | |
|---|---|---|---|
| 4,247,601 | 1/1981 | Wiegand | 428/611 |
| 4,660,025 | 4/1987 | Humphrey | 340/572 |
| 5,204,526 | 4/1993 | Yamashita et al. | 428/900 |

FOREIGN PATENT DOCUMENTS

| | | |
|---|---|---|
| A 0184637 | 6/1986 | European Pat. Off. . |
| 4-56752 | 2/1992 | Japan . |
| 5-159913 | 6/1993 | Japan . |
| 6-20811 | 1/1994 | Japan . |
| 6-44771 | 2/1994 | Japan . |

*Primary Examiner*—Patrick Ryan
*Assistant Examiner*—J. M. Gray
*Attorney, Agent, or Firm*—Pennie & Edmonds LLP

[57] ABSTRACT

A pulse generating element formed of a switchable magnetic wire is worked so as to have an arcuate shape such that the ratio R/d between the radius of curvature R and diameter d of the wire in a state free from external force ranges from 65 to 95. This is achieved by subjecting a wire of a ferromagnetic material, such as Fe—Co—V, to drawing-bending work. The pulse generating element, which is obtained by cutting the switchable magnetic wire to a predetermined length, is restricted to a substantially straight state by a retaining member, and undergoes a drastic flux reversal when it is subjected to an alternating field.

10 Claims, 3 Drawing Sheets

PULSE GENERATING ELEMENT AND A METHOD AND AN APPARATUS FOR MANUFACTURING THE SAME

BACKGROUND OF THE INVENTION

1. Field of the Invention

The present invention relates to a pulse generating element, such as a magnetic sensor, which is adapted for use in producing pulsative outputs depending on the change of external magnetic fields, and a method and an apparatus for manufacturing the same.

2. Description of the Related Art

Switchable magnetic wires having the Large Barkhausen effect can undergo a drastic flux reversal depending on the change of external magnetic fields, so that they are expected to be used in a wide variety of fields, taking advantage of their magnetic properties.

An example of a conventional switchable magnetic wire is composed of a central layer and a peripheral layer which are different in the magnitude of coercive force, and undergoes a drastic flux reversal when it is subjected to an alternating field. More specifically, if the switchable magnetic wire is subjected to a low-intensity external magnetic field (Ha) in a reverse direction such that the direction of magnetization of only the peripheral layer is reversed, after the wire is subjected to a high-intensity external magnetic field (not lower than Hp) such that the central and peripheral layers are magnetized in the same direction, weak voltage pulses (−Vs) are generated in a detecting coil which is wound on the wire. If the peripheral layer is subjected again to a substantial external magnetic field (Hp) in the same direction for the central layer, it undergoes a drastic flux reversal, whereupon sharp, intensive voltage pulses (+Vs) are generated in the detecting coil.

As an example of conventionally known means for manufacturing a switchable magnetic wire, there is a wire which is formed of a ferromagnetic material, such as Vicalloy (Fe—Co—V alloy) or Permalloy (Fe—Ni alloy), and is twisted or heat-treated so that its surface layer is permanently deformed.

In a magnetic wire described in Jpn. Pat. Appln. KOKOKU Publication No. 55-15797 (Prior Art 1), for example, a wire of a ferromagnetic material is subjected to a longitudinal tension high enough to leave it permanently elongated, whereby it is strained in the circumferential direction. Described in Jpn. Pat. Appln. KOKOKU Publication No. 61-28196 (Prior Art 2), moreover, is a magnetic device in which a wire of a ferromagnetic material is subjected to a torsional strain. Described in Jpn. Pat. Appln. KOKAI Publication No. 5-159913 (Prior Art 3) or 5-205958 (Prior Art 4), furthermore, is a device in which a wire of a ferromagnetic material is kept under a great tension in its axial direction, and the magnetic anisotropy of the wire in the axial direction is increased by the stress-magnetism effect so that the Large Barkhausen effect is produced with stability.

According to either of Prior Arts 1 and 2 described above, the manufacturing method is so complicated that the wires or devices cannot be mass-produced with high efficiency, and cannot be uniformly worked with ease, thus suffering substantial dispersion in properties. If the hardness (surface hardness in particular) of the wires to be twisted or retwisted is scattering, it is hard to twist the wires with a uniform strain throughout the length, so that uniform products with desired magnetic properties cannot be manufactured with reliability. Thin wires are particularly susceptible to these awkward circumstances.

In the cases of Prior Arts 3 and 4, on the other hand, the Large Barkhausen effect dies out if the tension is removed, so that it is necessary to provide a structure or mechanism for maintaining the tension, which entails higher equipment cost. The tension to be maintained is so high that it cannot be easily kept uniform. Even if the tension can be maintained with success, the wires change their properties with the lapse of time, thus failing to enjoy a satisfactory reliability.

SUMMARY OF THE INVENTION

Accordingly, the object of the present invention is to provide a pulse generating element capable of generating high-output pulses and having a Large Barkhausen effect to ensure stable magnetic properties, and a method and an apparatus for manufacturing the same.

In order to achieve the above object, a pulse generating element according to the present invention comprises an arcuate switchable magnetic wire formed of a ferromagnetic material and having a Large Barkhausen effect. The ratio (R/d) between the radius of curvature R and diameter d of the wire ranges from 65 to 95 when the wire is in a state free from external force.

The pulse generating element according to the invention can produce the Large Barkhausen effect of a certain level even when it is subjected to an alternating field without changing its arcuate shape. If the pulse generating element is restricted to a straight state when it is subjected to the alternating field, it can produce a greater Large Barkhausen effect. More specifically, the switchable magnetic wire is kept straight by means of a retaining member which is formed of a nonmagnetic material. When the alternating magnetic field is applied to the wire in this state, a drastic flux reversal is caused, and intensive voltage pulses are generated in a detecting coil.

The suitable material for the switchable magnetic wire may, for example, be a magnetically semi-hard magnetic alloy (with coercive force of, e.g., 10 to 100 Oe), such as Fe—Co—V, Fe—Ni—Cu, Fe—Co—Mo, or Fe—Mn—Ni, or a magnetically soft magnetic alloy (with coercive force of, e.g., 0.1 to 10 Oe), such as Permalloy, Fe-based amorphous alloy, Co-based amorphous alloy, soft ferrite, or Fe—Si. Preferably, the diameter of the switchable magnetic wire ranges from about 0.03 mm to 0.5 mm. Although the cross section of the wire should preferably be circular in shape, it may alternatively be elliptic or polygonal.

A method for manufacturing a pulse generating element according to the invention comprises steps of moving a wire of a ferromagnetic material in the axial direction thereof while pressing a die sideways against the wire under a tension, thereby subjecting the wire to drawing-bending work, so as to have an arcuate shape such that the ratio (R/d) between the radius of curvature R and diameter d of the wire in a state free from external force ranges from 65 to 95. The tension applied to the wire during the drawing-bending work, which ranges from about 10 to 100 $kgf/mm^2$, for example, is settled depending on the shape of the die, the bending angle of the wire at the point of contact between the wire and the die, etc.

An apparatus for manufacturing a pulse generating element according to the invention comprises wire supply means for supplying a wire formed of a ferromagnetic material, take-up means for winding up the wire while applying a tension thereto, and a die interposed between the wire supply means and the take-up means and adapted to come sideways into contact with the wire, thereby bending the wire. The wire is subjected to drawing-bending work by the die under a tension applied thereto by the wire supply means and the take-up means, whereby it is shaped so that the ratio (R/d) between its radius of curvature R and diameter d in a state free from the tension ranges from 65 to 95.

Pulse generating elements with various diameters d and radii of curvature R were manufactured by adjusting the tension applied to the wires, bending angle, bending radius, etc. in accordance with the hardness, diameter, etc. of the wires, and output voltages were measured with various ratios (R/d) between d and R. Thereupon, it was found that a maximum output was able to be obtained with R/d ranging from 65 to 95.

According to a conventional switchable magnetic wire, formed of a ferromagnetic wire which is bent into an arcuate shape by being simply wound on a columnar mandrel and alternating field is applied to the wire which is kept straight, in contrast with this, the pulse output produced by the Large Barkhausen effect is small, and moreover, gradually decreases to an extremely low level with the lapse of time. It is believed to be the cause of this phenomenon that a simple bending work, unlike the bending work according to the present invention which involves drawing operation, cannot produce a permanent strain which can add to the Large Barkhausen effect.

According to the present invention, pulse generating elements with high pulse outputs and uniform, stable properties can be manufactured at low cost and with higher mass-producibility than conventional ones which are permanently deformed by twisting. Capable of producing high outputs, the pulse generating elements of the invention are less susceptible to noises and less liable to changes on standing, thus ensuring high reliability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENTS

An embodiment of the present invention will now be described in detail with reference to the accompanying drawings.

Figure 1:
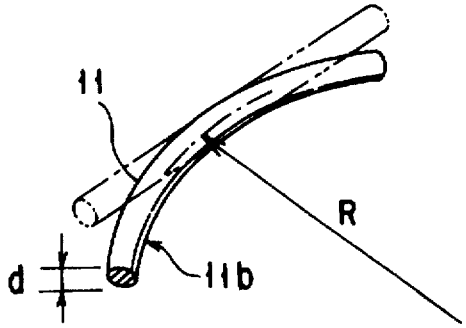
FIG. 1 is a perspective view showing part of a pulse generating element according to an embodiment of the present invention.
Figure 2:
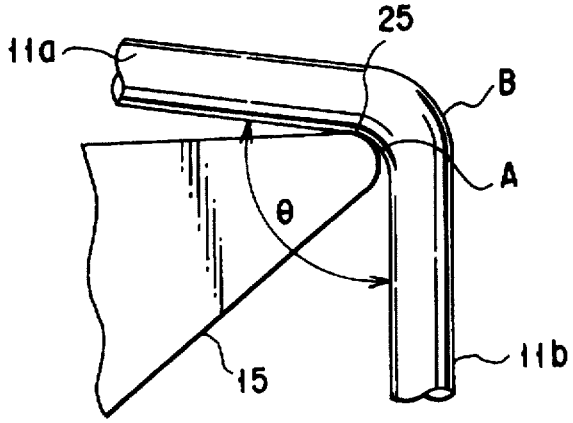
FIG. 2 is a side view of an apparatus for manufacturing the pulse generating element shown in FIG. 1.

A pulse generating element 11 shown in FIG. 1 is formed of a switchable magnetic wire 11*b* which is worked in the shape of a circular arc. The switchable magnetic wire 11*b* is manufactured by subjecting a wire 11*a* of a ferromagnetic material to drawing-bending work by means of a manufacturing apparatus 10 shown in FIGS. 2 to 4. The manufacturing apparatus 10 comprises a supply reel 13 for use as wire supply means, take-up reel 14 as take-up means, die 15, intermediate pulley 16, etc. The ferromagnetic wire 11*a* is wound on the supply reel 13.

The supply reel 13 and the take-up reel 14 are rotated by means of motors 20 and 21, respectively. By controlling the rotation of the two motors 20 and 21 by means of a controller 22, the wire 11*a* can be continuously fed under a constant tension in the direction of arrow F. Thus, the wire 11*a* is wound up by means of a torque in the take-up-side motor 21, and a torque in the direction to pull the wire 11*a* is produced in the supply-side motor 20. The wire 11*a* is subjected to drawing-bending work in a working section 25 of the die 15 in a manner such that it is drawn and moved in its axial (or longitudinal) direction as it is bent by the working section 25 which is brought sideways into contact with the wire 11*a*.

Figure 3:
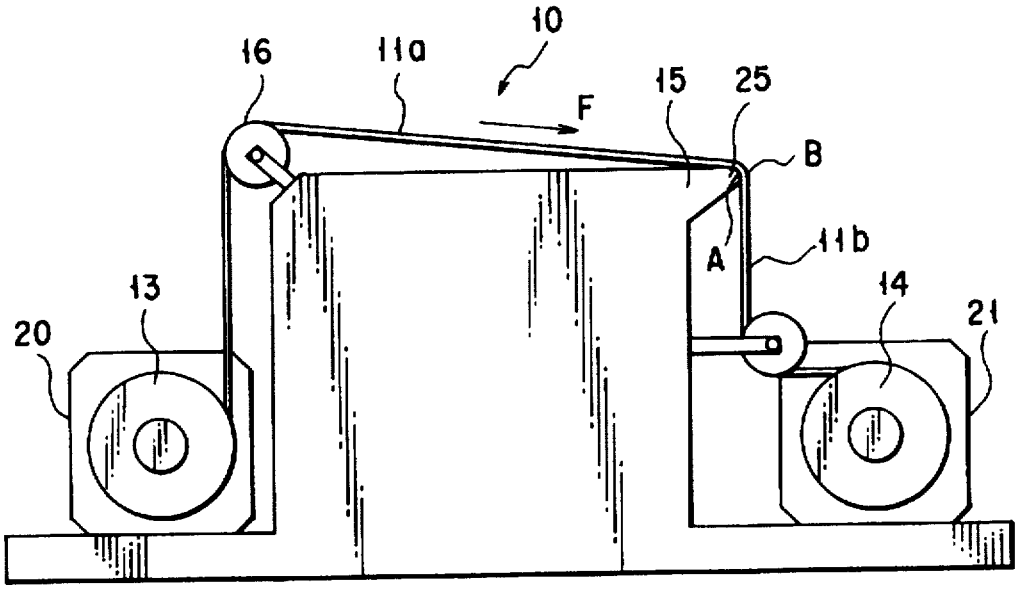
FIG. 3 is an enlarged side view showing part of the manufacturing apparatus shown in FIG. 2.
Figure 4:
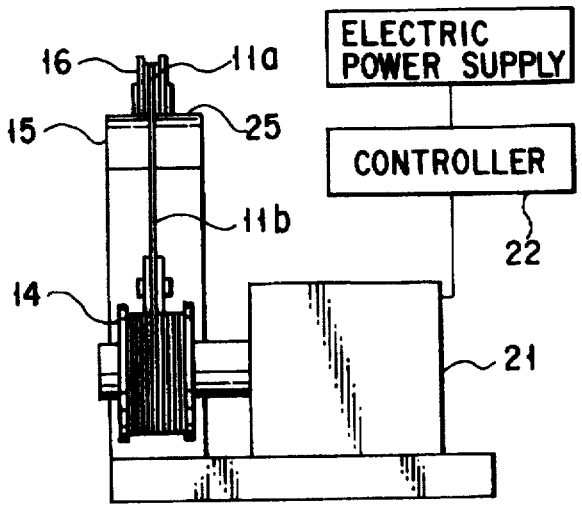
FIG. 4 is a front view of the apparatus shown in FIG. 2.

As shown in FIG. 3, an inside curvature portion A of the peripheral surface of the wire 11*a*, which is in contact with the working section 25, is pressed against the die 15 under the tension applied thereto. Thus, when the wire 11*a* moves in its lengthwise direction, its inside curvature portion A is continuously stroked in the lengthwise direction, so that it is subjected to a slip and compressive deformation. On the other hand, an outside curvature portion B of the wire 11*a*, which is not in contact with the working section 25, is subjected to the tension applied to the wire 11*a* and a tensile stress which is generated as the wire 11*a* is bent at the inside curvature portion A. Thereupon, a residual stress in the axial direction is maintained by the deformed portion.

As the aforesaid plastic deformation continuously advances in the axial direction of the wire 11*a*, the switchable magnetic wire 11*b* is continuously manufactured involving tension and bending stress therein, and is wound up by the take-up reel 14. The wire 11*b* on the reel 14 has a radius of curvature R, as shown in FIG. 1, when it is free from tension.

In the case of the manufacturing apparatus 10 described above, the radius of curvature R can be changed by selecting the tension applied to the wire 11*a*, shape of the working section 25, bending angle θ of the wire 11*a* at the working section 25, moving speed of the wire 11*a*, etc., depending on the diameter and material of the wire 11*a*.

The pulse generating element 11 with a predetermined length (e.g., tens of millimeters or thereabout) can be obtained by cutting the switchable magnetic wire 11*b* into pieces with the predetermined length after the aforesaid bending work. The arcuate pulse generating 10 element 11 is restricted to a substantially straight state, as indicated in two-dot chain line in FIG. 1. If an alternating magnetic field is applied to the element 11 in this state, a drastic flux reversal is caused so that a substantial Large Barkhausen effect can be produced.

By way of example, a Vicalloy wire composed of 50% Co, 40% Fe, and 10% V by weight was drawn to a diameter of 0.15 mm by means of a drawing die, and was annealed in a hydrogen atmosphere at 1,000° C. for an hour, whereupon the wire 11*a* was obtained. The wire 11*a* was pressed against the die 15 under a tensile load of 0.5 kgf by means of the apparatus 10, and was subjected to drawing-bending work at a constant speed of about 100 mm/sec, whereupon the switchable magnetic wire 11*b* was obtained.

Figure 5:
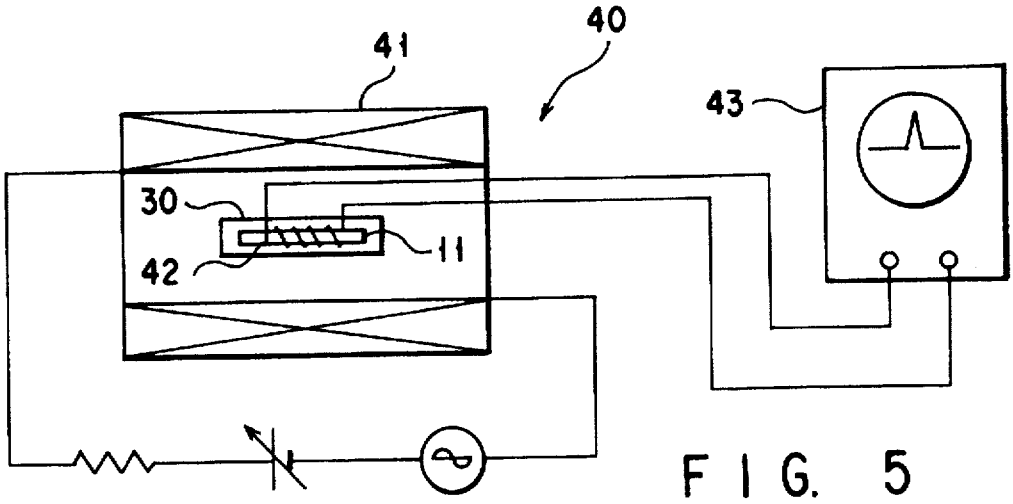
FIG. 5 is a diagram showing the pulse generating element and a circuit of an apparatus for measuring the Large Barkhausen effect.

The pulse generating element 11 was obtained by extracting an effectively worked portion of the switchable magnetic wire 11*b* fabricated in the aforesaid manner and cutting it to a length of 30 mm. The element 11 was inserted into a straight pipe of a nonmagnetic material for use as a retaining member 30, and the resulting structure was incorporated into a measuring apparatus 40 shown in FIG. 5. The measuring apparatus 40 is used to measure the Large Barkhausen effect produced in the pulse generating element 11. An alternating field was generated by supplying an AC current to an excitation coil 41, and the magnitude of a pulse voltage induced in a detecting coil 42 by the Large Barkhausen effect in the pulse generating element 11 was measured by means of an oscilloscope 43. Pulses were measured by using a sine-wave alternating field with a frequency of 50 Hz. The detecting coil 42 has an inside diameter of 1.5 mm, length of 10 mm, and 200 turns.

The retaining member 30 for holding the pulse generating element 11 is not limited to the form of a straight pipe. For example, it may be designed so that the pulse generating element 11 is fixed substantially straight to a nonmagnetic base plate by an adhesive. Alternatively, the pulse generating element 11 may be embedded in a nonmagnetic material such as resin.

Figure 6:
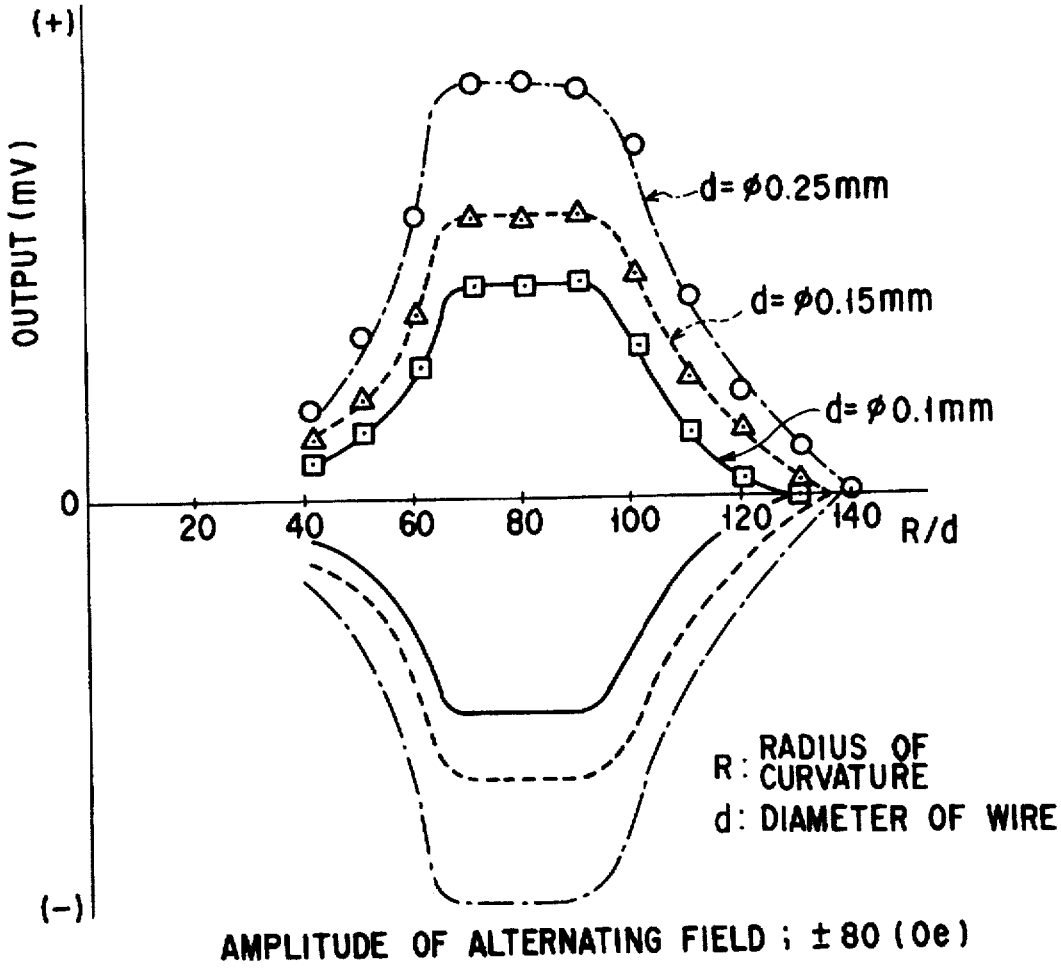
FIG. 6 is a diagram showing the relationships between the output and the ratios (R/d) between the respective radii of curvature and diameters of different elements.

Before the measuring test, a plurality of pulse generating elements 11 with various diameters d and radii of curvature R were manufactured by using the manufacturing apparatus 10, and their output voltages were measured by using the measuring apparatus 40, with the ratios (R/d) between d and R readjusted. FIG. 6 shows the results of the measurement. In FIG. 6, average values are plotted for samples with three different diameters. As seen from FIG. 6, a maximum output can be obtained without regard to the diameter d only if R/d ranges from 65 to 95.

Figure 7:
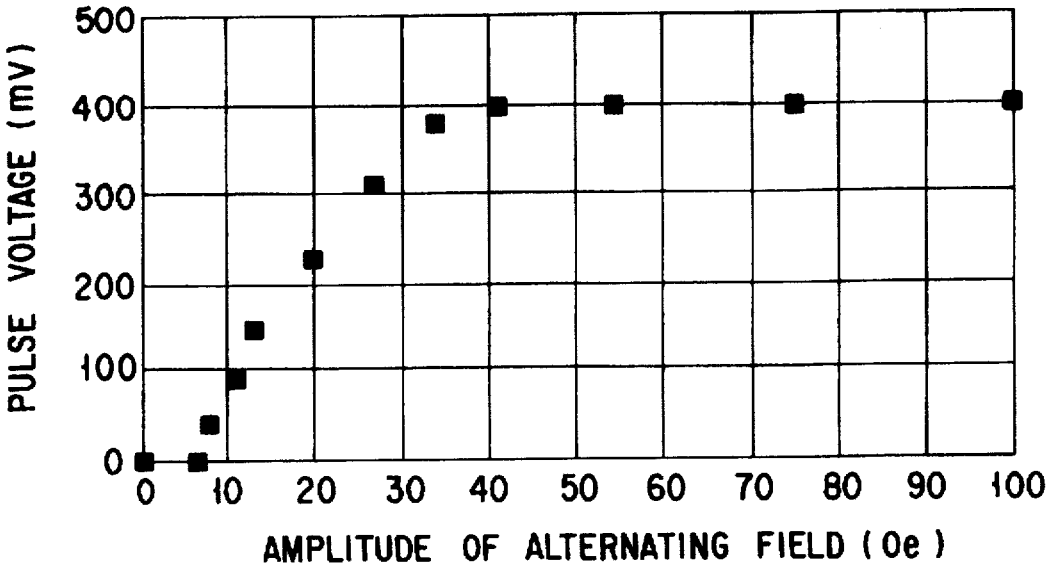
FIG. 7 is a diagram showing the relationship between the amplitude of an alternating field applied to the pulse generating element and pulse output voltage.

The relationship between the amplitude of the excitation alternating field and pulse output voltage established when the amplitude of the alternating field was changed from 0 to ±100 Oe, as shown in FIG. 7, by using the measuring apparatus 40 was examined before making the measurement shown in FIG. 6. Thereupon, it was ascertained that a substantially constant pulse voltage (about 400 mV) can be obtained with the amplitude of the alternating field at about ±40 Oe or more. Based on this recognition, the test of FIG. 6 was conducted with use of an alternating field of ±80 Oe.

Figure 8:
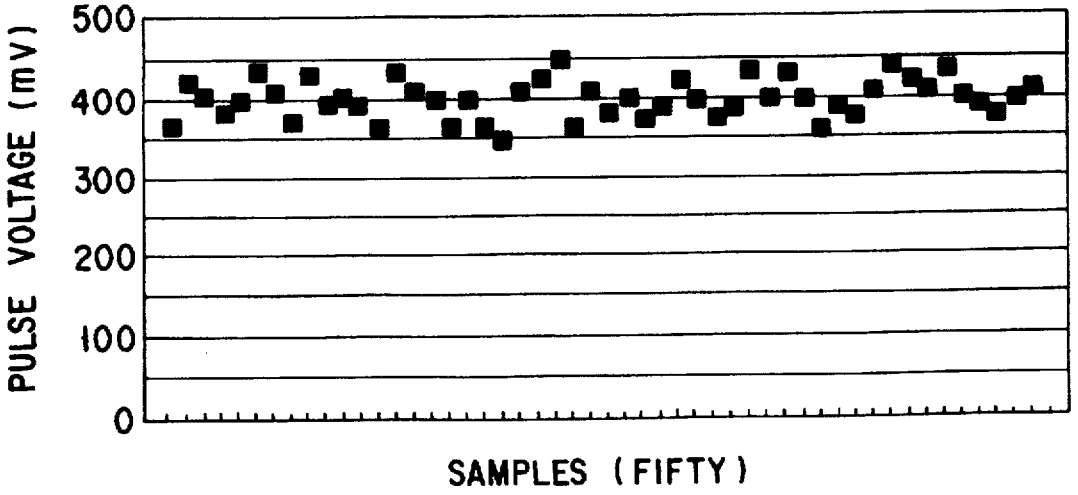
FIG. 8 is a diagram showing dispersion of the pulse voltages of 50 pulse generating element samples.

Pulse generating elements 11 (d=0.25 mm, R/d=80) of 30 mm length were cut from a Vicalloy wire manufactured by drawing-bending work under the same conditions as aforesaid by means of the manufacturing apparatus 10. Arbitrary 50 of these elements 11 were selected, and their respective pulse voltages were measured by using the measuring apparatus 40. FIG. 8 shows the results of the measurement. In this case, the amplitude of the alternating field was fixed at ±80 Oe. It was confirmed, as seen from FIG. 8, that any of the respective outputs of the 50 pulse generating elements 11 is within the range of 400 mV±50 mV.

As is evident from the above results, the high-output pulse generating elements 11 with a uniform, stable Large Barkhausen effect were able to be obtained by subjecting a magnetically semi-hard or soft magnetic alloy wire to drawing-bending work so that the ratio (R/d) between the radius of curvature R and diameter d in a state free from external force ranges from 65 to 95. Some of 50 samples, for example, of conventional switchable magnetic wires obtained by twisting produced no pulse voltages at all.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A pulse generating element comprising:

a switchable magnetic wire formed of a ferromagnetic material and having a Large Barkhausen effect such that a flux reversal is caused when subjected to an alternating field, the switchable magnetic wire being in the form of a circular arc and having an R/d ratio from 65 to 95 when in a state free from external force, where R is a radius of curvature of the wire and d is a diameter thereof.

2. A pulse generating element according to claim 1, wherein the material of said switchable magnetic wire is a magnetically semi-hard magnetic alloy selected among a group of materials including Fe—Co—V, Fe—Ni—Cu, Fe—Co—Mo, and Fe—Mn—Ni.

3. A pulse generating element according to claim 1, further comprising a retaining member for restricting the switchable magnetic wire with a predetermined length to a substantially straight state.

4. A pulse generating element according to claim 1, wherein the material of said switchable magnetic wire is a magnetically soft magnetic alloy selected among a group of materials including Permalloy, Fe-based amorphous alloy, Co-based amorphous alloy, soft ferrite, and Fe—Si.

5. A pulse generating element comprising:

a switchable magnetic wire formed of a ferromagnetic material and having a Large Barkhausen effect such that a flux reversal is caused when subjected to an alternating field, the switchable magnetic wire being in the form of a circular arc and having an R/d ratio from 65 to 95 when in a state free from external force, where R is a radius of curvature of the wire and d is a diameter thereof, and retaining means for restricting said switchable magnetic wire to a substantially straight state.

6. A pulse generating element according to claim 5, wherein said retaining means comprises a straight pipe which houses said switchable magnetic wire.

7. A pulse generating element according to claim 5, wherein said retaining means comprises a base plate of nonmagnetic material, to which said switchable magnetic wire is fixed by an adhesive.

8. A pulse generating element according to claim 8, wherein said retaining means is a nonmagnetic member made of resin in which said switchable magnetic wire is embedded.

9. A pulse generating element comprising a substantially straightened ferromagnetic wire, said wire having an arcuate shape when in a state free from external force, wherein the wire is one which has not been subjected to substantial torsional straining.

10. The pulse generating element of claim 9 wherein the wire has an R/d ratio from 65 to 95 when in a state free from external force, where R is a radius of curvature of the wire and d is a diameter thereof.

* * * * *